US005343721A

United States Patent [19]

Calnen

[11] Patent Number: 5,343,721

[45] Date of Patent: Sep. 6, 1994

[54] IGNITION LOCKING DEVICE

[76] Inventor: Charles R. Calnen, 8173 Wolfe Rd., Cattaraugus, N.Y. 14719

[21] Appl. No.: 92,954

[22] Filed: Jul. 19, 1993

[51] Int. Cl.[5] ..... E05B 65/12

[52] U.S. Cl. ..... 70/18; 70/39; 70/237; 70/424; 70/428; 70/455

[58] Field of Search ..... 70/14, 18, 19, 22, 24–26, 70/30, 49, 38 A, 39, 237, 417, 423, 424, 427, 428, 455

[56] References Cited

U.S. PATENT DOCUMENTS

| | | | |
|---|---|---|---|
| 1,890,806 | 12/1932 | Enos | 70/26 |
| 3,756,008 | 9/1973 | Smith | 70/18 X |
| 3,948,069 | 4/1976 | Imbriano | 70/428 |
| 4,008,590 | 2/1977 | Berkowitz | 70/428 X |
| 4,074,550 | 2/1978 | Rowlings | 70/428 X |
| 4,098,102 | 7/1978 | Kalina | 70/237 |
| 4,104,895 | 8/1978 | Tankel | 70/237 |
| 4,118,961 | 10/1978 | Lee | 70/18 X |
| 4,157,602 | 6/1979 | Pennell | 70/18 X |
| 4,407,146 | 10/1983 | Nielsen, Jr. | 70/18 X |
| 4,426,861 | 1/1984 | Chillis | 70/39 |
| 4,584,855 | 4/1986 | Burlingame | 70/39 X |
| 4,918,949 | 4/1990 | Newbold | 70/39 X |
| 5,113,674 | 5/1992 | LiCausi | 70/237 X |

FOREIGN PATENT DOCUMENTS

| | | | |
|---|---|---|---|
| 7648 | 10/1899 | Norway | 70/49 |
| 2044 | of 1896 | United Kingdom | 70/25 |
| 602687 | 6/1948 | United Kingdom | 70/49 |

*Primary Examiner*—Peter M. Cuomo
*Assistant Examiner*—Suzanne L. Dino

[57] ABSTRACT

A device is disclosed for locking the key ignition of a vehicle. The device includes braided cables encased in neoprene rubber, and a recess is provided at the midpoint of the length of these cables. A locking housing is basically cylindrical in shape and includes a combination lock in its center section while the ends of the housing are flared angularly outward and have two through holes which serve as receptacles for the cables. Finally, ratchet-like teeth are arranged along the length of the cable, and two spring loaded engagement levers are located in the cable receptacles within the housing. The cables fit around the steering column of a vehicle with the recess placed over the key ignition. The locking housing receives the cables in the through holes and is locked in place by the combination lock.

5 Claims, 4 Drawing Sheets

IGNITION LOCKING DEVICE

BACKGROUND OF THE INVENTION

1. Field of the Invention

The present invention relates generally to locking devices, and more particularly, to a locking device especially adapted to concealing a car ignition to prevent use of the car.

2. Description of the Prior Art

Locking devices in the form of anti-car theft devices are well known. U.S. Pat. No. 4,848,955 dated Jul. 18, 1989 discloses an anti-theft collar in the form of an arcuate band having a hole to accommodate a shift lever and a wedge having opposed edges for insertion of a locking wedge. Similarly, U.S. Pat. No. 4,020,662 dated May 3, 1977 discloses a shackle comprising a collar and a cap, the cap being locked to the collar over the ignition. U.S. Pat. No. 5,092,145 dated Mar. 3, 1992 discloses a lock keeper mounted on a shaft comprising discs pierced with an orifice for receiving the shaft. Finally, U.S. Pat. No. 4,104,895 dated Aug. 8, 1978 discloses a protective device having a casing including a shackle at one end and a bolt lock at the other end to engage an aperture in the shackle.

A need exists, though, for a locking device which is easily fabricated and inexpensively manufactured. A further need exists for a device to easily lock the ignition of a car and prevent "hot wiring" of the car, use by drunk drivers and tampering of the car by children.

The foregoing need is met by the present invention as will be made apparent from the following description thereof. Other advantages of the present invention over the prior art also will be rendered evident.

SUMMARY OF THE INVENTION

To achieve the foregoing and other advantages, the present invention, briefly described, provides a device for locking the key ignition of a vehicle. The device includes braided cables encased in neoprene rubber, and a recess is provided at the midpoint of the length of these cables. A locking housing is basically cylindrical in shape and includes a combination lock in its center section while the ends of the housing are flared angularly outward and have two through holes which serve as receptacles for the cables. Finally, ratchet-like teeth are arranged along the length of the cable, and two spring loaded engagement levers are located in the cable receptacles within the housing. The cables fit around the steering column of a vehicle with the recess placed over the key ignition. The locking housing receives the cables in the through holes and is locked in place by the combination lock.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved ignition locking device which has all of the advantages of the prior art and none of the disadvantages.

It is another object of the present invention to provide a new an improved Ignition locking device which may be easily and efficiently manufactured and marketed.

It is a further objective of the present invention to provide a new and improved Ignition locking device which is of durable and reliable construction.

An even further object of the present invention is to provide a new and improved Ignition locking device which is susceptible of a low cost of manufacture with regard to both materials and labor, and which accordingly is then susceptible of low prices of sale to the consuming public, thereby making such Ignition locking device available to the buying public.

Still yet a further object of the present invention is to provide a new and improved ignition locking device which is easily attached and removed from a steering column.

It is still a further object of the present invention is to provide a new and improved ignition locking device which prevents "hot wiring", use by drunk drivers and tampering, by children, of the vehicle.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved Ignition locking device embodying the principles and concepts of the present invention will be described.

Figure 1:
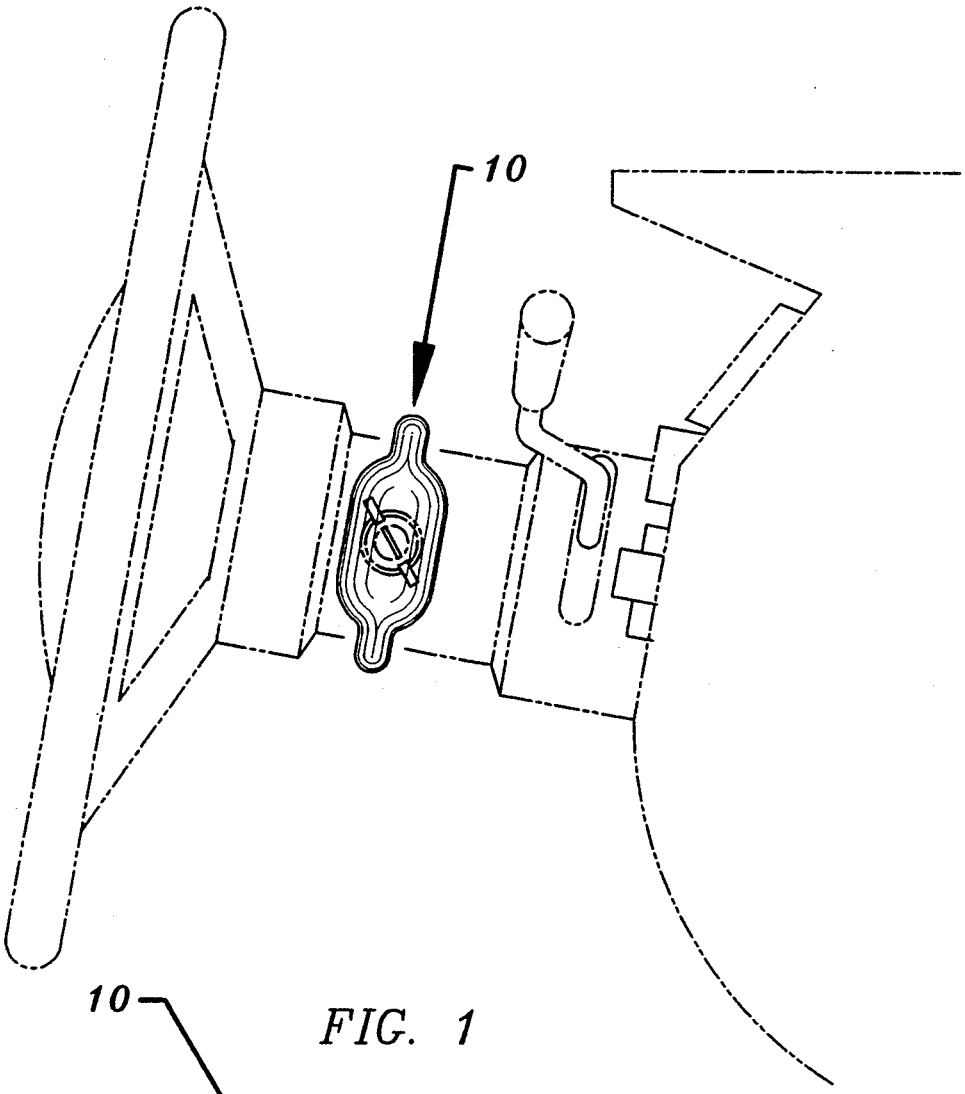
FIG. 1 is a side view of the ignition locking device of the present invention attached to a car steering column.
Figure 2:
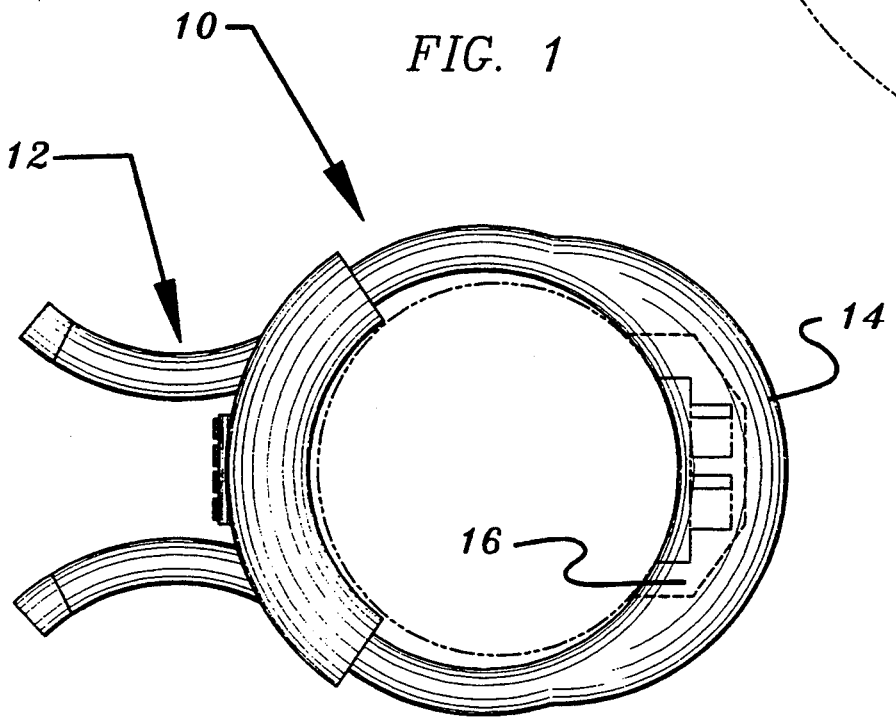
FIG. 2 is an elevational view of the ignition locking device of the present invention.
Figure 3:
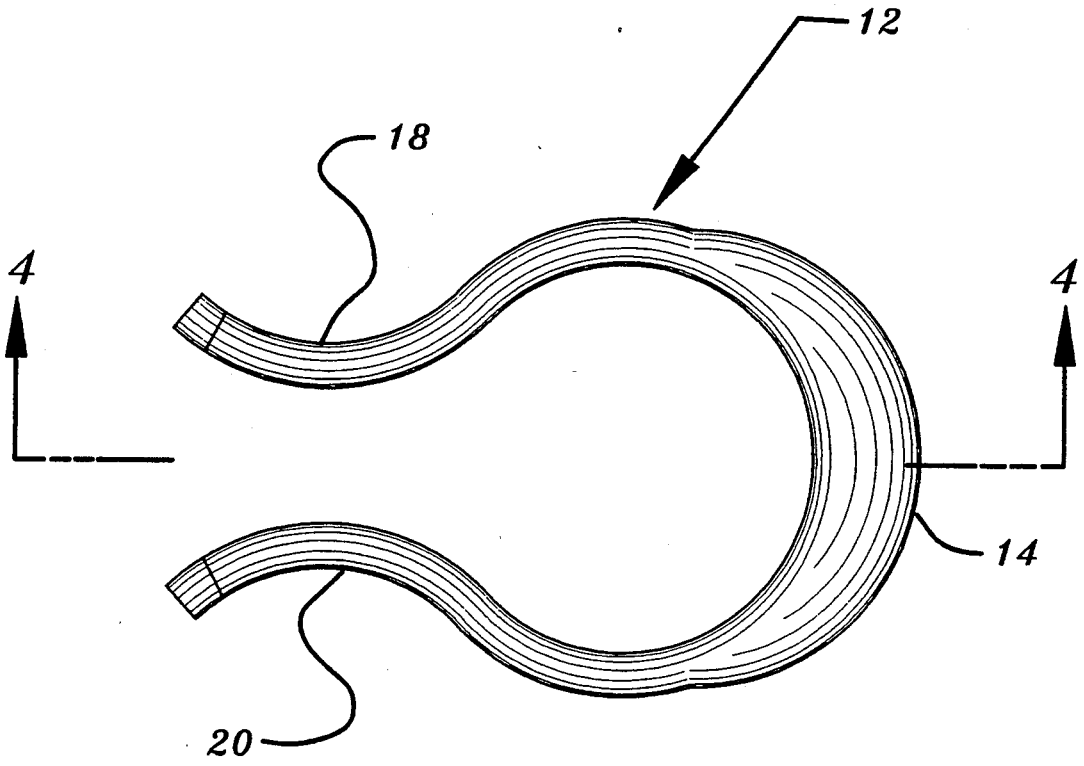
FIG. 3 is an elevational view of the cable section of the present invention.
Figure 4:
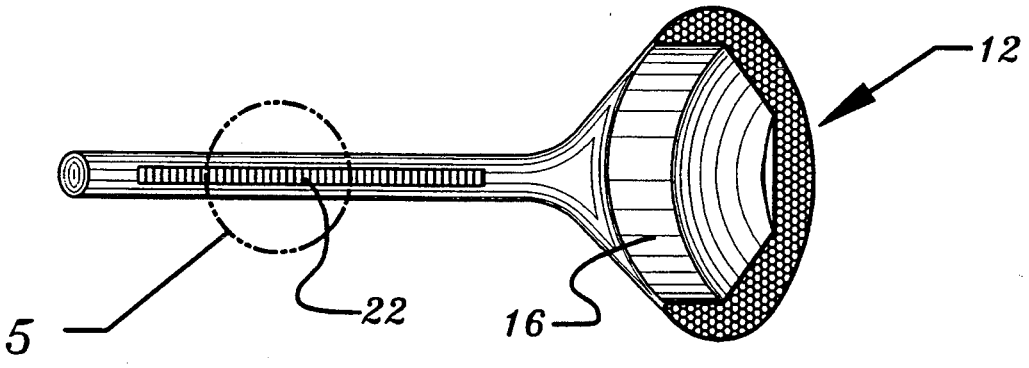
FIG. 4 is a cross-sectional view of the cable section taken along the line 4—4 of FIG. 3.
Figure 5:
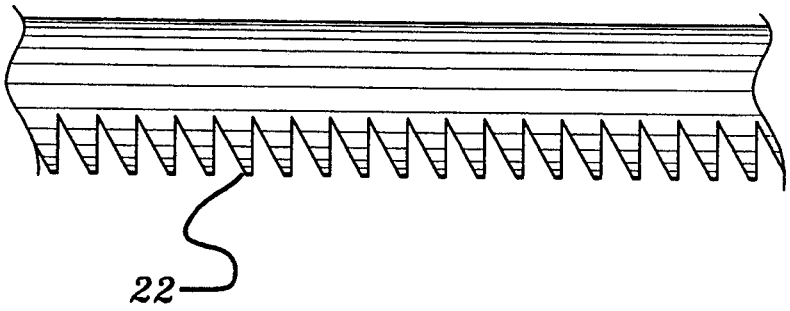
FIG. 5 is a view of the encircled portion 5 of FIG. 4.
Figure 6:
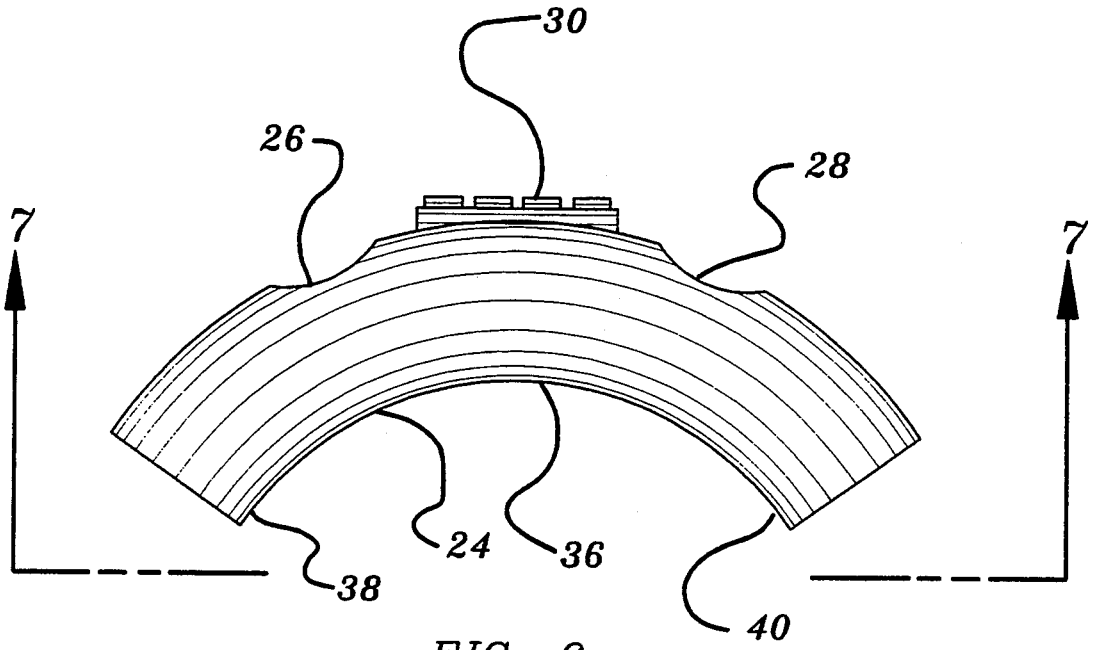
FIG. 6 is a perspective view of the locking housing of the present invention.
Figure 7:
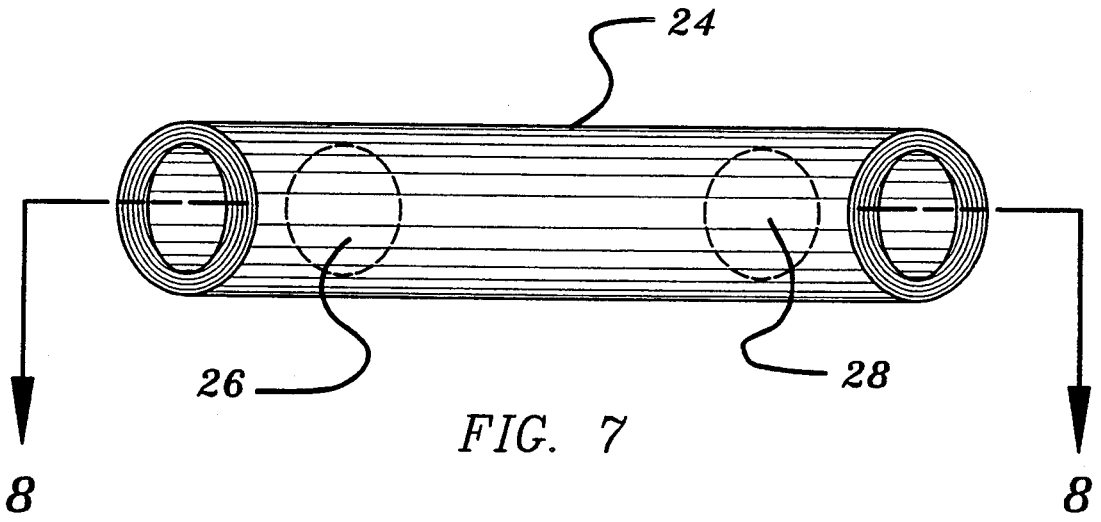
FIG. 7 is a view of the locking housing taken along the line 7—7 of FIG. 6.
Figure 8:
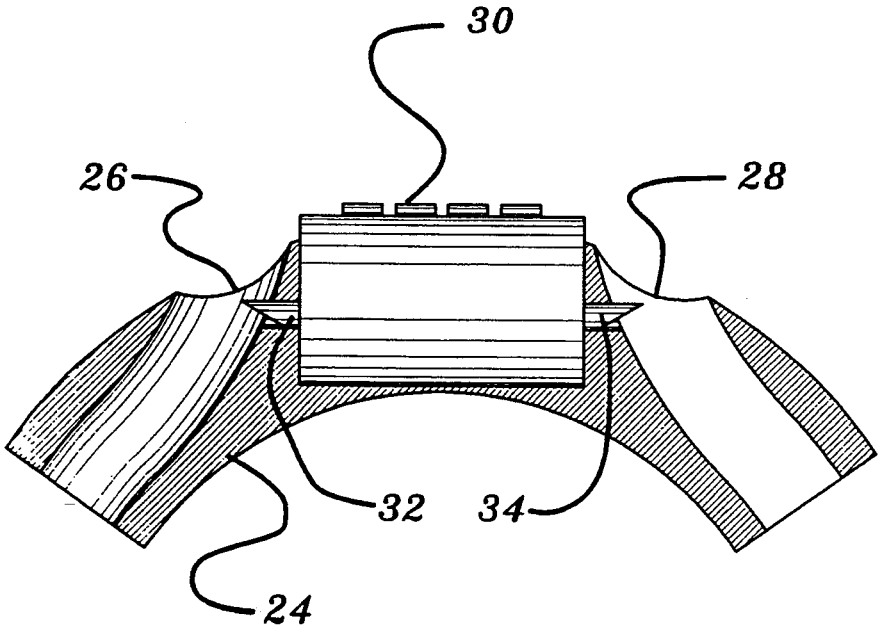
FIG. 8 is a cross-sectional view of the locking housing taken along the line 8—8 of FIG. 7.

Turning to FIGS. 1-8, there is shown a preferred embodiment of the ignition locking device of the invention generally designated by reference numeral 10. In its preferred form, the ignition locking device 10 comprises generally a horseshoe shaped cable section 12. The circular portion 14 of the horseshoe shaped cable section 12 having a recess 16 extending along the portion 14. The end portions 18 and 20 are arced and extending away from each other. Along the inside arced sides of end portions 18 and 20 are teeth 22 substantially as shown in FIGS. 4 and 5. A locking housing in the form of an arced collar 24 having holes 26 and 28 extending through its width on either side of its midsection is also provided. This arced collar 24 also includes a lock 30. Within the holes 26 and 28 are bolts 32 and 34. The end portions 18 and 20 of the cable section 12 fit into the holes 26 and 28 of the arced collar 24 and is held in place by the bolts 32 and 34. These bolts 32 and 34 fit into the teeth 22 of the end portions 18 and 20 respectively when the end portions 18 and 20 are placed through holes 26 and 28. The lock 30 locks bolts 32 and 34 in position between the teeth 22.

The arced collar 22 includes a midsection 36 between holes 26 and 28 which is rigid and made of tube steel. This portion houses the lock 30. The arced collar 22 also includes end portions 38 and 40. These end portions 38 and 40 extend from the outside of holes 26 and 28 respectively and are flexible. These sections are made of double wire braid covered with neoprene rubber. The end portions of the horseshoe shaped cable section are also made of double wire braid.

In operation the horseshoe shaped cable section is placed around the steering column of a car. The recess of the circular portion is placed in a position covering the ignition key receptacle. The end portions of the horseshoe shaped cable section are placed through the holes in the arced collar. The arced collar is then pushed flush against the steering column. The end portions may be pulled taught to tighten the arced collar. The lock is then activated and the ignition locking device is locked in place.

To remove the ignition locking device, simply key in the combination to unlock the bolts. The collar is then easily removed from the steering column and the ignition locking device is deactivated.

It is apparent from the above that the present invention accomplishes all of the objectives set forth by providing a new and improved ignition locking device which is easily attached and removed from a steering column and prevents "hot wiring", use by drunk drivers and tampering, by children, of the vehicle.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved ignition locking device comprising:
   - a horseshoe shaped cable section, including
   - a circular portion having a recess extending along an inside section; and
   - first and second end portions arced outward from each other wherein each of the first and second end portions includes serrated edges on an inside portion thereof; and
   - a locking housing, including
   - first and second holes, each hole having a respective bolt extending therethrough and positioned at opposite ends of a midsection of said housing; and
   - a locking device, located within the midsection of the housing, wherein the circular portion is positioned around a key ignition of a vehicle, the first and second end portions are positioned within the first and second holes, respectively, and the first and second end portions are locked in position within the respective hole by the respective bolt,
   - wherein the housing includes first and second end portions each positioned on an outside of the first and second holes respectively and wherein each of the housing first and second end portions is composed of a double wire braid covered with neoprene rubber.

2. The invention of claim 1, wherein the midsection of the housing is made of tube steel.

3. The invention of claim 2, wherein the locking device is a combination lock.

4. The invention of claim 3, wherein each of said first and second locking housing end portions includes an opening for receiving a corresponding one of said first and second end portions of said horseshoe shaded cable section therethrough respectively, each said opening being in communication with each of said first and second holes respectively.

5. An ignition locking device assembly comprising:

a flexible arcuate member having a central section and a pair of elongated end sections, said central member having a recess on the inside surface thereof with respect to the axis of curvature of said arcuate member, said recess adapted to receive therein the steering column mounted ignition lock of an automobile, and an arcuate flexible locking collar, said locking collar having a middle portion and first and second opposed end portions defining first and second end faces respectively, each of said end portions having a passageway extending from its respective end face toward said middle portion respectively, first and second openings in said collar spaced inwardly along said locking collar with respect to said end faces respectively, and being located on opposite sides of said middle portion respectively, each said passageway extending between one of said respective end faces and a corresponding one of said first and second openings whereby said elongated end sections are adapted to extend through each of said corresponding end faces, passageways, and openings respectively, and locking means in said locking collar middle portion for releasably lockingly engaging each of said elongated end sections in each of said passageways, respectively.

* * * * *